United States Patent [19]

Ferguson et al.

[11] 4,156,390

[45] May 29, 1979

[54] DETONATOR IGNITER

[75] Inventors: Robert M. Ferguson; Normand Jérôme, both of St-Paul L'Ermite, Canada

[73] Assignee: Canadian Arsenals Limited, Ottawa, Canada

[21] Appl. No.: 746,248

[22] Filed: Dec. 1, 1976

[30] Foreign Application Priority Data

Nov. 22, 1976 [CA] Canada ..... 266290

[51] Int. Cl.[2] ..... F42C 19/12

[52] U.S. Cl. ..... 102/28 R

[58] Field of Search ..... 102/28 R, 46, 70.2 A, 102/203; 149/20, 26

[56] References Cited

U.S. PATENT DOCUMENTS

| | | | |
|---|---|---|---|
| 1,034,160 | 7/1912 | Starkweather | 102/46 |
| 2,696,191 | 12/1954 | Sheehan | 102/46 |
| 2,918,871 | 12/1959 | Taylor | 102/28 R |
| 2,960,032 | 11/1960 | Sahlin | 102/46 |
| 3,390,636 | 7/1968 | Perkins et al. | 102/28 R |
| 3,793,920 | 2/1974 | Sheran | 102/28 R |

FOREIGN PATENT DOCUMENTS

| | | | |
|---|---|---|---|
| 812257 | 4/1959 | United Kingdom | 102/28 R |

*Primary Examiner*—Verlin R. Pendegrass

*Attorney, Agent, or Firm*—Laff, Whitesel & Rockman

[57] ABSTRACT

An igniter for a detonator comprising, an electrode having a first face, a second electrode, having a second face disposed in a facing position a predetermined distance from the first face, and a particulate electrically resistive composition packed in the space between said faces.

11 Claims, 10 Drawing Figures

DETONATOR IGNITER

This invention is an igniter for use in a detonator for pyrotechnic explosive devices. It is particularly directed to an electrically operated igniter which has improved operation at low voltages.

To ignite an explosive or pyrotechnic device, a heat source such as a resistive wire or film through which a current passes, or a dielectric which breaks down upon application of voltage, is used in intimate contact therewith. One type of ignition structure utilizes a conducting composition of particles disposed in a cavity. A current is conducted through the composition, causing rapid heating, explosion of an adjacent detonator, resulting in explosion of the explosive or pyrotechnic. The present invention is directed to the latter type of ignition structure.

Early conducting composition ignition devices utilized a mixture of carbon and an explosive, requiring approximately sixty volts to be applied for firing. Such devices were found to be sensitive to high voltage-low energy static discharges, and consequently were not commercially used. However, a more successful conducting composition was graphite mixed with normal lead styphnate, loaded and pressed in a dry condition into a percussion cap. More recently, the explosive component in such structures was lead azide.

However, these prior art devices still required fairly significant amounts of energy to fire. The present invention increases the reliability of firing of such caps, while at the same time substantially reduces the energy requirements for firing.

The inventive igniter is comprised of an electrode having a first face, a second electrode, having a second face disposed in a facing position a predetermined distance from the first face, and a particulate electrically resistive composition packed in the space between the faces.

It should be noted that the term "conductive composition" and "resistive composition" will be used interchangeably in this specification. The purpose of the composition is to conduct electricity. However, due to physical effects at the surfaces of the particles providing an equivalent resistance, heating occurs very rapidly when current is flowing therethrough. Consequently the compositions have a resistive effect, and can be called either resistive or conductive compositions interchangeably.

Figure 2:
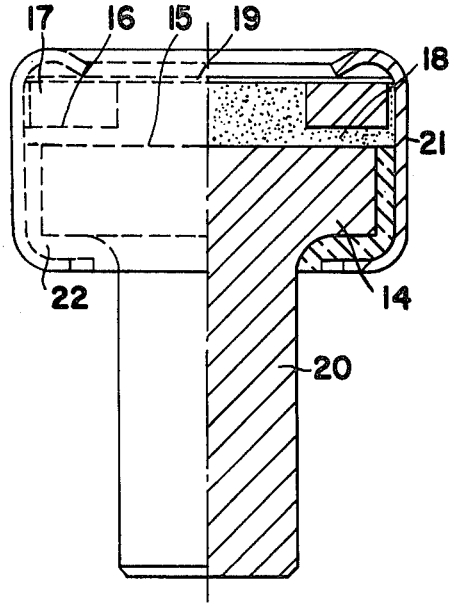
Figure 3A:
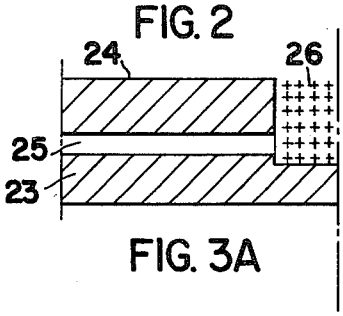
Figure 3B:
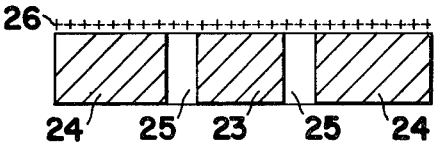
Figure 3C:
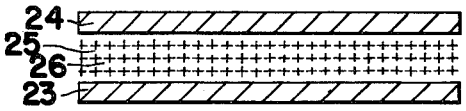
Figure 4:
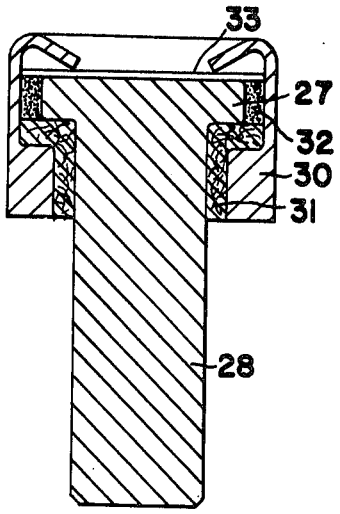
Figure 5:
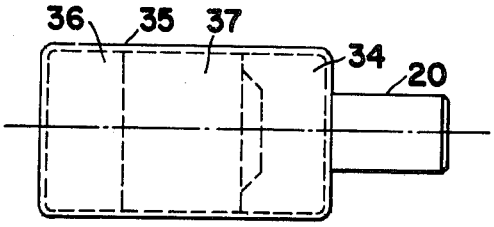

A better understanding of the invention and its difference from the prior art will be obtained by reference to the description below, and the following drawings, in which:

FIGS. 1*a*, 1*b*, 1*c* and 1*d* show cross-sectional views of prior art igniter devices;

FIG. 2 shows a cross-section of the preferred embodiment of the inventive igniter device;

FIGS. 3*a*, 3*b* and 3*c* are schematic cross-sectional views for depicting current paths in the prior art and in the present invention;

FIG. 4 is a cross-sectional view of a second embodiment of the invention;

FIG. 5, which is out of its proper numerical order, and is on the same sheet as FIG. 2, is an X-ray view of the igniter device in a detonator.

FIG. 1 shows a prior art igniter for use in a detonator cap. A first electrode 1 has a flat face which is adjacent an annular second electrode 2. A cylindrical housing 3 has inwardly extending lips which hold the assembly together. An insulator 4 electrically separates the first electrode 1 from the housing 3 and the second electrode 2.

Within the hole of the annular second electrode a conductive or resistive particulate composition 5 is located. An insulating spacer 6 holds the composition 5 under pressure in its proper location.

During operation, an electrical potential is applied between the first and second electrodes. Conducting paths are formed through the particulate composition 5, rapidly heating, and causing ignition of any adjacent pyrotechnic or explosive material.

Figure 1A:
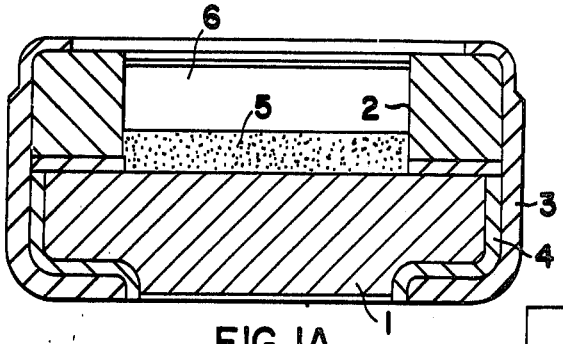
FIG. 1A (PRIOR ART)
Figure 1B:
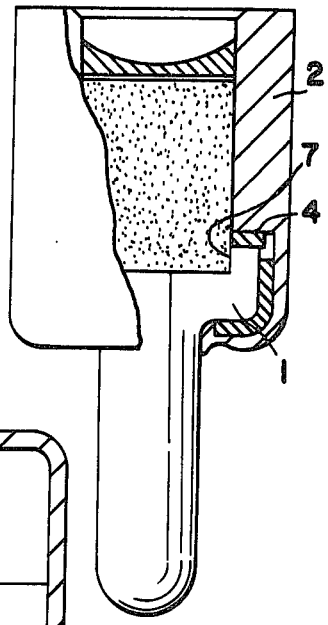
FIG. 1B (PRIOR ART)

The structure shown is FIG. 1*b* was an improved design over the structure shown in FIG. 1*a*. In this structure, the first electrode 1 diameter was decreased, and a cavity 7 located in its face. The first electrode was fitted with a post for ease of application of an electric terminal thereto. The second electrode 2 was formed so as to provide simultaneous use as the housing, and after assembly, the bottom portion of the second electrode was formed into a lip, holding the entire ignition device together. The gap between the first and second electrodes was determined by the width of insulator 4, usefully provided by a fiber washer.

Figure 1C:
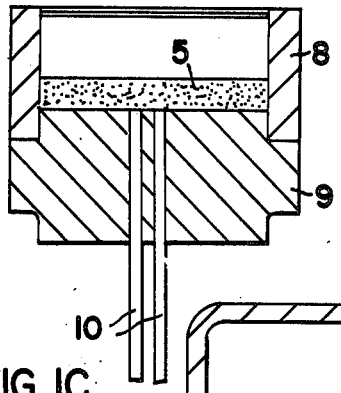
FIG. 1C (PRIOR ART)

FIG. 1*c* shows a further variation of the prior art ignition device. The housing for the conductive particulate composition 5 was comprised of an insulating cylindrical wall 8 fitted on a base 9. A pair of electrodes 10 protrude through the base 9 to make contact with the conducting composition 5. The conducting composition is held in position either by a spacer or by other explosive materials.

Figure 1D:
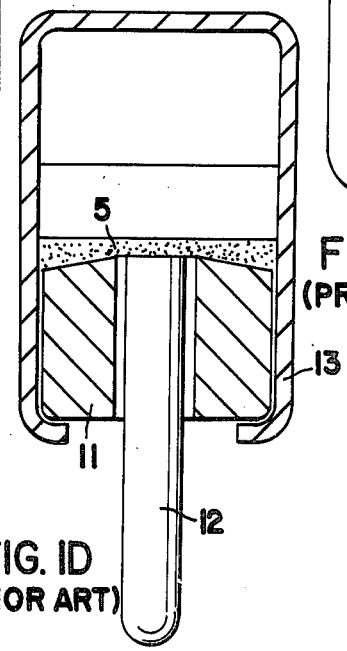
FIG. 1D (PRIOR ART)

FIG. 1*d* shows a further prior art ignition device in which the base is formed by a thick-walled conductive cylinder 11 forming a first electrode. A second electrode comprising a conductive post 12 protrudes through it along its axis to contact the conductive material 5 resting on a commonly formed surface. The gap between the cylinder and conductive post is maintained by a cylindrical insulating tube. The entire assembly is fitted into a cylindrical casing 13, which has one end closed, and its other end formed into a lip under cylinder 11. The conductive composition is held in position by a lid or by other explosive materials.

FIG. 2 shows the improved ignition device. A first electrode 14 has a first face 15 which faces the second face 16 of an annular second electrode 17. A particulate electrically resistive composition 18 is packed in the space between the faces. The composition is also packed within the hole of the annular second electrode.

A conductive disk 19 overlies and is in contact with the surface of the second electrode opposite the first electrode. A terminal post 20 extends centrally outward from the first electrode opposite the second electrode. A cylindrical housing 21 encloses and extends past the opposite edges of the first electrode and the conductive disk. The housing 21 has inwardly turned lips at both of its ends. An insulator 22 surrounds the first electrode adjacent the cylindrical housing. The diameter of the housing and the spacing between the lips thereof are such as to retain the electrodes and disk in spaced relationship, with predetermined pressure on the resistive particulate composition.

The improvement over the prior art will now be described with reference to FIGS. 3*a*–3*c*. FIG. 3*a* shows a portion of the first and second electrodes 23 and 24 which are of the prior art type used in FIGS. 1*a* and 1*b*. A gap 25 separates the electrodes. Region 26 is filled with the particulate material.

During operation, it will be seen that the shortest current path between the electrodes 23 and 24 through the particulate material occurs adjacent the gap 25 and the current must follow increasing path lengths at positions farther from the gap. Clearly, the shorter the conduction path, the less energy is required to bridge the distance between the electrodes. Consequently the major portion of the particulate composition contributes little to the most efficient and shortest conduction paths which allow the ignition device to operate with reliability and low voltage.

FIG. 3*b* shows a pair of electrodes 23 and 24 of the prior art type shown in FIG. 1*d*. In this case, electrode 24 is annular, and electrode 23 is located within its hole separated from electrode 24 by insulating gap 25. Again in this configuration, the current paths of least energy will be those shortest paths which bridge the gap 25 directly on the surface of the electrodes. The farther the current path is from the upper surface of the electrodes, the longer the current path, and the more energy required to bridge it. The bulk of the particulate conducting composition therefore will be seen to contribute little to the efficient and short conduction paths.

FIG. 3*c* depicts the improved structure. This figure shows electrodes 23 and 24 which represent the facing positions of electrodes 14 and 17 of FIG. 2.

In this structure the gap between the two electrodes is completely filled with the particulate resistive composition. Consequently the gap 25 and region 26 occupy the same space. Now there are a multiplicity of paths in the particulate composition which can conduct between the electrodes; there is no shortest path since all paths are the same.

Since there are a large number of parallel paths, conducting with equal ability through the composition, a relatively small amount of energy is required to heat the composition and cause ignition. The improvement over the prior art devices is substantial.

In the preferred embodiment shown in FIG. 2, the casing is of thin-walled stainless steel. The insulation 22 is a fiber washer about 2.55 millimeters thick which is pressed into position. The electrode 17 is a stainless steel washer; the first electrode 14 is also made of stainless steel. The conductive disk 19 is of aluminum foil, for sealing the assembly.

In the preferred method of manufacture, the insulating washer forming insulator 22 is partly punched out of a strip, which is fed over the casing held in a mold. The bottom of the casing had been previously turned inward. A punch then presses the washer out of the strip into the bottom of the casing. Electrode 14 is then fed into the case, its post extending through the fiber washer. The particulate composition is dispensed volumetrically into the housing 21, to provide a height of composition not less than about 90 micrometers and not more than about 180 micrometers (between 4 and 8 milligrams), or approximately 6 milligrams.

Typically the casing is about 1.6 millimeter long and 3.1 millimeters in diameter.

Electrode 17 is dispensed by punching from a partly punched strip on top of the dispensed charge of conducting composition. A strip of aluminum foil is interposed between the punch and the casing 21. The punch then cuts the aluminum foil while providing a pressing load of from about $172.37\times10^6$ to $289.56\times10^6$ Newtons per square meter. A portion of the particulate composition is extruded up the central hole of the top electrode to provide a stemming channel to the main charge of explosive in the detonator.

The top of housing 21 is then closed in a turnover operation of the upper lip of the case, over the disk 19, and the second electrode 17, holding the entire assembly together under pressure.

It has been found that the particle size and particle size distribution is important to the control of the conducting characteristics of the particulate composition. Lead azide with an average particle size of 30 micrometers and a surface area between 700–800 square centimeters per gram has been found to be useful. The lead azide should be mixed with graphite thoroughly to provide a homogeneous mixture. The graphite should have an average particle size of 9 micrometers, all particles being smaller than about 32 micrometers. There should be about 2.75% to 3% by weight of graphite in the mixture.

FIG. 4 shows a sectional view of a second embodiment of the invention. A solid cylindrically-shaped first electrode 27 head has a diameter greater than a post 28 which extends downwardly therefrom along its axis. A second electrode 30 is cylindrical in shape and has one portion of slightly greater diameter than the head, surrounding the head. A second portion of slightly greater diameter than the post, but smaller than the head, surrounds the post. Insulating means 31 surrounding the post retains the first and second electrodes electrically separated.

The particulate electrically conductive composition is packed between the first and second electrodes in the region 32. An insulating disk 33 is disposed over the top surface of the first electrode 27.

The upper edge of the second electrode 30 is bent over into a lip, inwardly and over the top of the insulating disk 33. This retains the entire assembly together, the spacing between the electrodes being maintained by insulating means In this embodiment, the opposing electrode faces are cylindrical in shape; the outer surface of the head of the first electrode 27 at its widened diameter faces the opposite inner cylindrical surface of second electrode 30 across constant width region 32 within the particulate conductive composition is held.

The insulator 22 in the embodiment of FIG. 2, and the insulator 31 of the embodiment of FIG. 4 can be of glass or ceramic, and thus can be used to provide a hermetic glass to metal seal. The resulting detonator can then be completely hermetically sealed.

The conductive composition can be made with explosives other than lead azide. For instance, a suitable crystalline explosive form of silver azide can be substituted. Alternatively, a mixture of explosives and sensitizers may replace the single explosive component in the conducting composition.

In addition, a conductant other than graphite or a combination with graphite can be used. For instance aluminum, silver, tungsten, and mixtures thereof with each other and with graphite can be used.

FIG. 5 shows in X-ray view the igniter structure 34 in combination with other elements to form a detonator. A cylindrical casing 35 surrounds the cylindrical housing of the igniter structure 34. A lip of casing 35 is turned under the edge of the structure 34 adjacent the post 20. The other end of the cylindrical casing 35 is closed.

Within the casing are enclosed layers of an explosive charge 36 and of a free flowing high bulk density azide of about similar azide value as lead azide. The entire assembly is held under predetermined pressure, such as about $82.74\times10^6$ to $103.42\times10^6$ Newtons per square meter. Preferably the cylindrical casing is of thin-walled stainless steel material.

Typically, the casing is about 7.1 millimeters long by 3.4 millimeters in diameter, and the post is about 2.3 millimeters long, the igniter dimensions being suitable to match.

A useful explosive charge of from 24 to 26 milligrams of RDX has been successfully used in the detonator, with lead azide under pressure of from about $68.9\times10^6$ to $82.74\times10^6$ Newtons per square meter.

It should be noted that the present invention is considerably easier to manufacture than those igniters of the prior art. For instance, the structures of FIGS. 1*a* and 1*b* require very close control of the concentricity between the components which form the electrodes and the insulating gap. Slight eccentricities increase the path lengths, and affect the efficiency.

The prior art structures of FIGS. 1*c* and 1*d* require a highly controlled process. Special techniques would be required to provide sufficient pull strength between the pin electrode and the header.

It is also common with many previous systems to require gold or silver plated electrode surfaces to provide good electrical contact with the particulate composition, since only small electrode surface areas are actually efficiently in use. The present invention does not require such plated surfaces, since large electrode surface areas are available for contact.

Since the afore-noted special component manufacture requirements are now eliminated, the present invention can be used using the more economical punch press method of component and final assembly processing. Standard detonator filling equipment can also be readily modified to be used in production of the present igniter structure.

Someone skilled in the art understanding this invention may now conceive of variations, utilizing the disclosed principles. All considered within the scope of the present invention as defined in the appended claims.

The embodiments of the invention in which an exclusive property or privilege is claimed, are defined as follows:

1. An igniter for a detonator comprising:

(a) an electrode having a first face, the first face being disk-shaped;

(b) a second electrode, the second electrode being annularly-shaped, and having a second face disposed in a facing position to form a gap within a predetermined distance between the first and second faces; and (c) a particulate electrically resistive composition packed in the gap between said faces, said composition being additionally packed within the central hole of the second electrode, the resistive composition further being a homogeneous mixture of particles of lead azide and graphite, the graphite being between 2.75% and 3.0% of the mixture by weight, the average particle size of the lead azide being about 30 micrometers, the average particle size of the graphite being about 9 micrometers and being smaller than 32 micrometers;

further including a conductive disk overlying and in contact with the surface of the second electrode opposite the first electrode, a terminal post extending centrally outward from the first electrode opposite to the second electrode, a cylindrical housing enclosing and extending past the opposite edges of the first electrode and the conductive disk, having inwardly turned lips at both ends for retaining the disc and the housing, and an insulator surrounding the first electrode adjacent the cylindrical housing, whereby the diameter of the housing and the spacing between the lips thereof are such as to retain the electrodes and disk in spaced relationship, with predetermined pressure on said composition.

2. An igniter as defined in claim 1, in which the outer diameter of the first and second electrodes are about 2.5 millimeters, the inner diameter of the second electrode is about 1.5 millimeters, the thickness of the second electrode is about 0.38 millimeters, and the amount of resistive composition is between 4 and 8 milligrams.

3. An igniter for a detonator comprising:

(a) an electrode having a first face, the first face being disk-shaped;

(b) a second electrode, the second electrode being annularly-shaped, and having a second face disposed in a facing position to form a gap within a predetermined distance between the first and second faces; and (c) a particulate electrically resistive composition packed in the gap between said faces, said composition being additionally packed within the central hole of the second electrode, the resistive composition further being a homogeneous mixture of particles of crystalline explosive silver azide or lead azide with one or more of aluminum, silver, tungsten and graphite, further including a conductive disk overlying and in contact with the surface of the second electrode opposite the first electrode, a terminal post extending centrally outward from the first electrode opposite to the second electrode, a cylindrical housing enclosing and extending past the opposite edges of the first electrode and the conductive disk, having inwardly turned lips at both ends for retaining the disc and the housing, and an insulator surrounding the first electrode adjacent the cylindrical housing, whereby the diameter of the housing and the spacing between the lips thereof are such as to retain the electrodes and disk in spaced relationship, with predetermined pressure on said composition.

4. An igniter for a detonator comprising:

(a) an electrode having a first face, the first electrode being cylindrical in shape and forming a flat head to a cylindrical post of diameter less than that of the head;

(b) a second electrode, having a second face disposed in a facing position to form a gap within a predetermined distance between the first and second faces, the second electrode being cylindrical in shape, having one portion of slightly greater diameter than the head, surrounding the head, and a second portion of slightly greater diameter than the post, but smaller than the head, surrounding the post;

(c) insulating means for retaining the first and second electrodes electrically separated;

(d) a particulate electrically resistive composition packed in the gap between said faces, said composition being packed between the first and second electrodes, said composition being a homogeneous mixture of particles of lead azide and graphite, the graphite being between 2.75% and 3% of the mixture by weight, the average particle size of the lead azide being about 30 micrometers, the average particle size of the graphite being about 9 micrometers and all graphite particles being smaller than 32 micrometers; and (e) an insulating disk of the size of the inner diameter of the second electrode located above the first electrode; the second electrode having an inwardly extending lip sandwiching the disk, the head of the first electrode and said composition against said second portion of the second electrode with a predetermined pressure.

5. An igniter as defined in claim 4 in which the insulating means is a glass or ceramic.

6. An igniter for a detonator comprising:

(a) an electrode having a first face, the first electrode being cylindrical in shape and forming a flat head to a cylindrical post of diameter less than that of the head;

(b) a second electrode, having a second face disposed in a facing position to form a gap within a predetermined distance between the first and second faces, the second electrode being cylindrical in shape, having one portion of slightly greater diameter than the head, surrounding the head, and a second portion of slightly greater diameter than the post, but smaller than the head, surrounding the post;

(c) insulating means for retaining the first and second electrodes electrically separated;

(d) a particulate electrically resistive composition packed in the gap between said faces, said composition being packed between the first and second electrodes, the resistive composition being a homogeneous mixture of particles of crystalline explosive silver azide or lead azide with one or more of aluminum, silver, tungsten and graphite; and (e) an insulating disk of the size of the inner diameter of the second electrode located above the first electrode; the second electrode having an inwardly extending lip sandwiching the disk, the head of the first electrode and said composition against said second portion of the second electrode with a predetermined pressure.

7. An igniter as defined in claim 4, in which the predetermined pressure is $206.84\times10^6$ to $275.79\times10^6$ Newtons per square meter.

8. An igniter as defined in claim 6, in which the head diameter of the first electrode is about 2.5 millimeters, the inner diameter of the second electrode surrounding the head is about 2.8 millimeters, the thickness of the head of the first electrode is about 0.8 millimeter, and the amount of resistive composition is between 4 and 8 milligrams.

9. An igniter as defined in claim 8, in which said pressure is about $82.74\times10^6$ to $103.42\times10^6$ Newtons per square meter.

10. An igniter as defined in claim 8, in which the casing is of thin-walled stainless steel material.

11. An igniter as defined in claim 8, in which the casing is about 7.1 millimeters long and about 3.4 millimeters in diameter, the explosive charge is about 24 to 26 milligrams of RDX pressed from about $82.74\times10^6$ to $103.42\times10^6$ Newtons per square meter, the azide is about 62 to 67 milligrams of lead azide pressed from about $68.94\times10^6$ to $82.74\times10^6$ Newtons per square meter, and the casing is of thin-walled stainless steel.

* * * * *